US007782348B2

(12) United States Patent
Ohnishi

(10) Patent No.: US 7,782,348 B2
(45) Date of Patent: Aug. 24, 2010

(54) EXPOSING DEVICE AND IMAGE FORMING APPARATUS INCORPORATING THE SAME

(75) Inventor: Masato Ohnishi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/019,928

(22) Filed: Jan. 25, 2008

(65) Prior Publication Data

US 2008/0181668 A1 Jul. 31, 2008

(30) Foreign Application Priority Data

Jan. 30, 2007 (JP) ..... 2007-019440

(51) Int. Cl.
*B41J 2/385* (2006.01)
*B41J 2/41* (2006.01)
*B41J 2/435* (2006.01)

(52) U.S. Cl. ..... 347/138; 347/152; 347/245; 347/263

(58) Field of Classification Search ..... 347/138, 347/152, 245, 263

See application file for complete search history.

(56) References Cited

U.S. PATENT DOCUMENTS 5,953,042 A * 9/1999 Nabeta et al. ..... 347/263
6,243,128 B1 * 6/2001 Yamakawa ..... 347/263
2004/0169716 A1 * 9/2004 Serizawa et al. ..... 347/245

* cited by examiner

*Primary Examiner*—Matthew Luu
*Assistant Examiner*—Kendrick X Liu
(74) *Attorney, Agent, or Firm*—Gerald E. Hespos; Michael J. Porco

(57) ABSTRACT

An exposing device includes a light source that emits scanning light, a polygonal rotating mirror that scans and deflects the scanning light in a specific scanning direction, a reflection mirror that reflects the scanning light that has been scanned and deflected at plural reflection points aligned in a specific direction for the scanning light to go incident on the image carrier, and a unit main body in which the polygonal rotating mirror and the reflection mirror are disposed at a specific interval. The unit main body has two attachment fixing portions on almost a same line linking the reflection points and fixed to the apparatus main body. An attachment support is supported on the apparatus main body and allows free expansion of the unit main body in a plane direction including the scanning direction of the polygonal rotating mirror on a side where the polygonal rotating mirror is installed.

15 Claims, 5 Drawing Sheets

EXPOSING DEVICE AND IMAGE FORMING APPARATUS INCORPORATING THE SAME

BACKGROUND OF THE INVENTION

1. Field of the Invention

The present invention relates to an exposing device that irradiates scanning light onto the surface of an image carrier and an image forming apparatus incorporating the same.

2. Description of the Related Art

In an image forming apparatus employing an electrophotographic process, the exposing device irradiates scanning light onto the surface of a pre-charged image carrier, for example, a photoconductive drum. Accordingly, an electrostatic latent image is formed on the surface of the drum and a toner image corresponding to the electrostatic latent image is transferred and fixed onto a sheet of paper.

A higher degree of accuracy is required when installing the exposing device in the image forming apparatus main body. This is because only a slightest displacement of the irradiation position of scanning light on the photoconductive drum can have a direct influence on the image quality. In view of the foregoing, a technique for an exposing device that takes into account a temperature change inside the apparatus main body has been disclosed (for example, see JP-A-2000-180766).

In the prior art above, a unit main body incorporating optical devices, such as a polygon mirror and a reflection mirror, is fixed to the apparatus main body at a portion where the rigidity is relatively low. More specifically, a unit main body of an almost square shape when viewed in plane is fixed to the apparatus main body at the center of the respective edges apart from the corners. The purpose of this configuration is to lessen an amount of deformation by making the rigidity homogeneous across the entire unit main body.

However, in a case where all the four edges are immovable as with this unit main body, the unit main body is not able to respond to a temperature change. The inability is attributed to a phenomenon that when the temperature of the unit main body rises, heat stress develops at least toward the center portion of the unit main body. This phenomenon becomes particularly noticeable when a polygon mirror is incorporated therein. The relative positions between the reflection mirror and the drum vary with the level-rising or -falling at the center portion of the unit main body, which poses a problem that a desired irradiation position cannot be attained. The technique in the prior art therefore has a still-unsolved problem regarding a response to a temperature change.

SUMMARY OF THE INVENTION

An object of the invention is to provide an exposing device in which the relative positions between the reflection mirror and the image carrier remain invariant even in the presence of a temperature change and an image forming apparatus incorporating the same.

An exposing device according to an aspect of the invention to achieve the above and other objects includes: a light source that emits scanning light; a polygonal rotating mirror that scans and deflects the scanning light in a specific scanning direction; a reflection mirror that reflects the scanning light that has been scanned and deflected at plural reflection points aligned in a specific direction for the scanning light to go incident on the image carrier; and a unit main body in which the polygonal rotating mirror and the reflection mirror are disposed at a specific interval. The unit main body includes a pair of attachment fixing portions that are provided on almost a same line linking the plural reflection points and fixed to the apparatus main body, and an attachment supporting portion that is supported on the apparatus main body and allows free expansion of the unit main body in a plane direction including the scanning direction of the polygonal rotating mirror on a side where the polygonal rotating mirror is installed.

The exposing device can be incorporated into an image forming apparatus including an image carrier on which an electrostatic latent image is formed, an apparatus main body accommodating therein the image carrier and the exposing device, first supporting portions provided inside the apparatus main body so as to support the exposing device fixedly, and a second supporting portion provided inside the apparatus main body so as to allow free expansion of the exposing device.

DETAILED DESCRIPTION OF THE PREFERRED EMBODIMENTS

Hereinafter, a preferred embodiment of the invention will be described with reference to the drawings.

Figure 1:
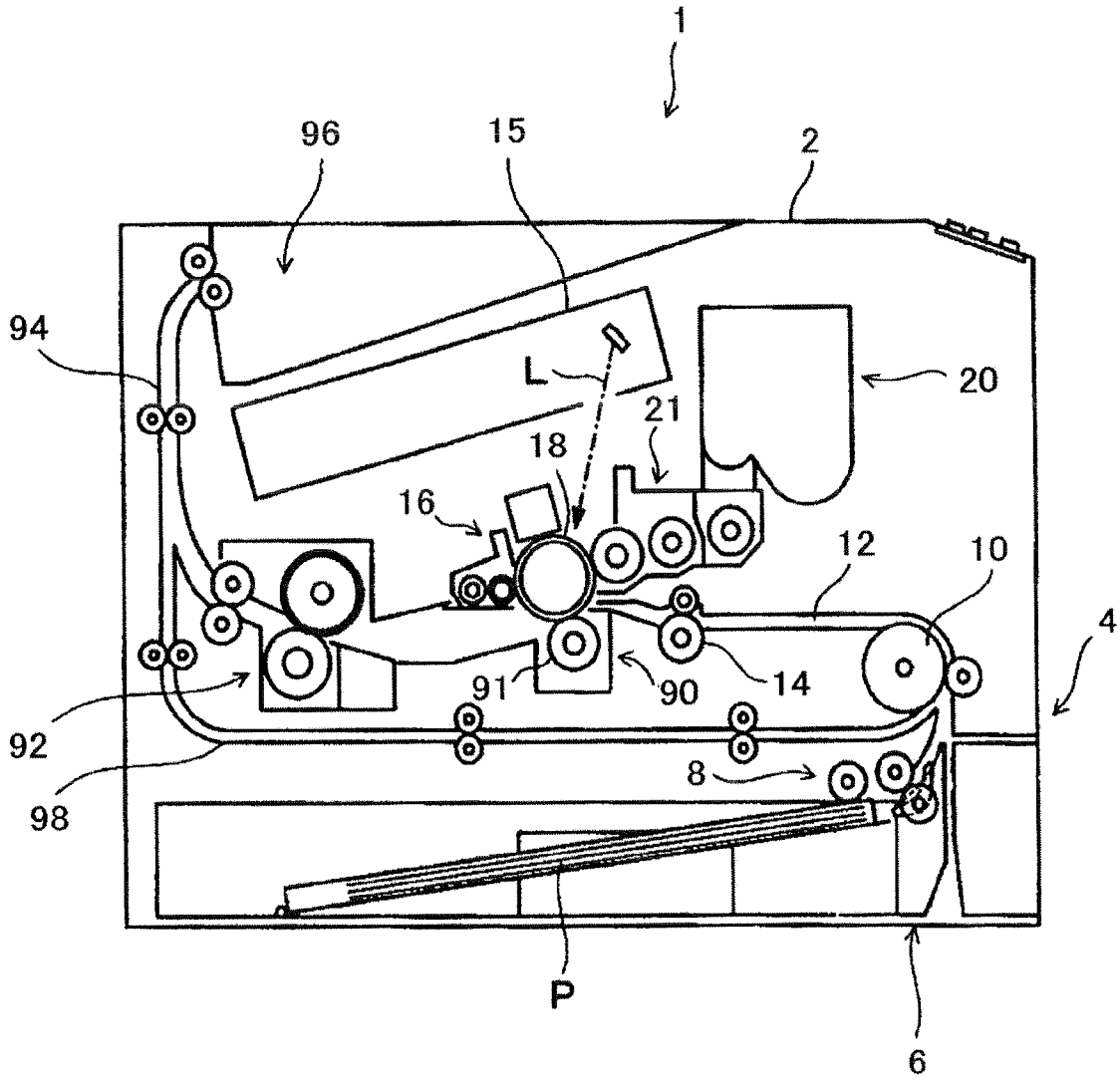
FIG. 1 is a cross section schematically showing the configuration of a printer according to one embodiment of the invention.

FIG. 1 is a cross section schematically showing the configuration of a printer 1 according to one embodiment of an image forming apparatus of the invention. The drawing shows the cross section viewed from the left side surface of the printer 1. The front surface and the rear surface of the printer 1 are therefore positioned, respectively, on the right and on the left of the drawing.

The printer 1 includes a box-shaped apparatus main body 2. In the apparatus main body 2 are accommodated various unit components for image formation, such as an image forming portion 16, an exposing unit 15 (exposing device), a fixing portion 92, and a toner replenishing device 20.

A paper storing device 4 is disposed at the bottom inside the apparatus main body 2. A paper feeding cassette 6 is provided to the storing device 4, and sheets of paper P in a piled state are stored in the paper feeding cassette 6. The paper P is sent toward the upper right of the cassette 6 in FIG. 1 by a paper feeding portion (paper feeding roller) 8, and the paper P thus sent is inverted toward the rear surface inside the apparatus main body 2 and transported further toward the rear surface in this state. The paper feeding cassette 6 is formed so that it can be pulled out in the right direction in the drawing. New sheets of paper P can be replenished or the sheets of paper P can be replaced with sheets of paper of a different kind in the cassette 6 while it is in a pulled-out state.

Inside the apparatus main body 2, a feed roller 10, a paper-feeding paper transportation path 12, a registration roller 14, an image forming portion 16, and a transfer portion 90 are sequentially disposed downstream of the paper storing device 4 in a paper feeding direction. A photoconductive drum 18 (image carrier) on which is formed an electrostatic latent image is provided to the image forming portion 16 at the center thereof.

The exposing unit 15 forms an electrostatic latent image on the peripheral surface of the photoconductive drum 18. The exposing unit 15 is disposed above the image forming portion 16, and as is indicated by an alternate long and short dash line in the drawing, it irradiates scanning light (laser beam) L toward the photoconductive drum 18. Further, a transfer roller 91 is provided to the transfer portion 90. The transfer roller 91 is pressed by the photoconductive drum 18 from below and forms a transfer nip portion. In the transfer nip portion, a toner image is transferred onto the sheet P using toner particles supplied from a toner replenishing device 20 and a developing device 21.

In addition, a fixing portion 92, a paper-discharging paper transportation path 94, and a paper discharging portion 96 are sequentially disposed downstream of the image forming portion 16 and the transfer portion 90 in the paper transportation direction. The paper transportation path 94 extends upward from downstream of the fixing portion 92 along the rear surface of the apparatus main body 2. Further, it bends toward the front surface at the top position of the apparatus main body 2. The paper discharging portion 96 is formed on the top surface of the apparatus main body 2, so that it can receive the paper P discharged from the end of the paper transportation path 94 and pile it in the height direction. The printed sheet P stored in the paper discharging portion 96 can be readily taken out from the outside.

A duplex printing paper transportation path 98 is formed below the transfer portion 90 and the fixing portion 92 in a space between these portions and the paper storing device 4. The paper transportation path 98 branches from the paper transportation path 94 at a position along the rear surface of the apparatus main body 2, and extends downward. Also, the paper transportation path 98 is bent toward the front surface inside the apparatus main body 2 to extend horizontally and merges with the paper transportation path 12 at an immediate downstream position of the paper feeding portion 8.

Figure 2:
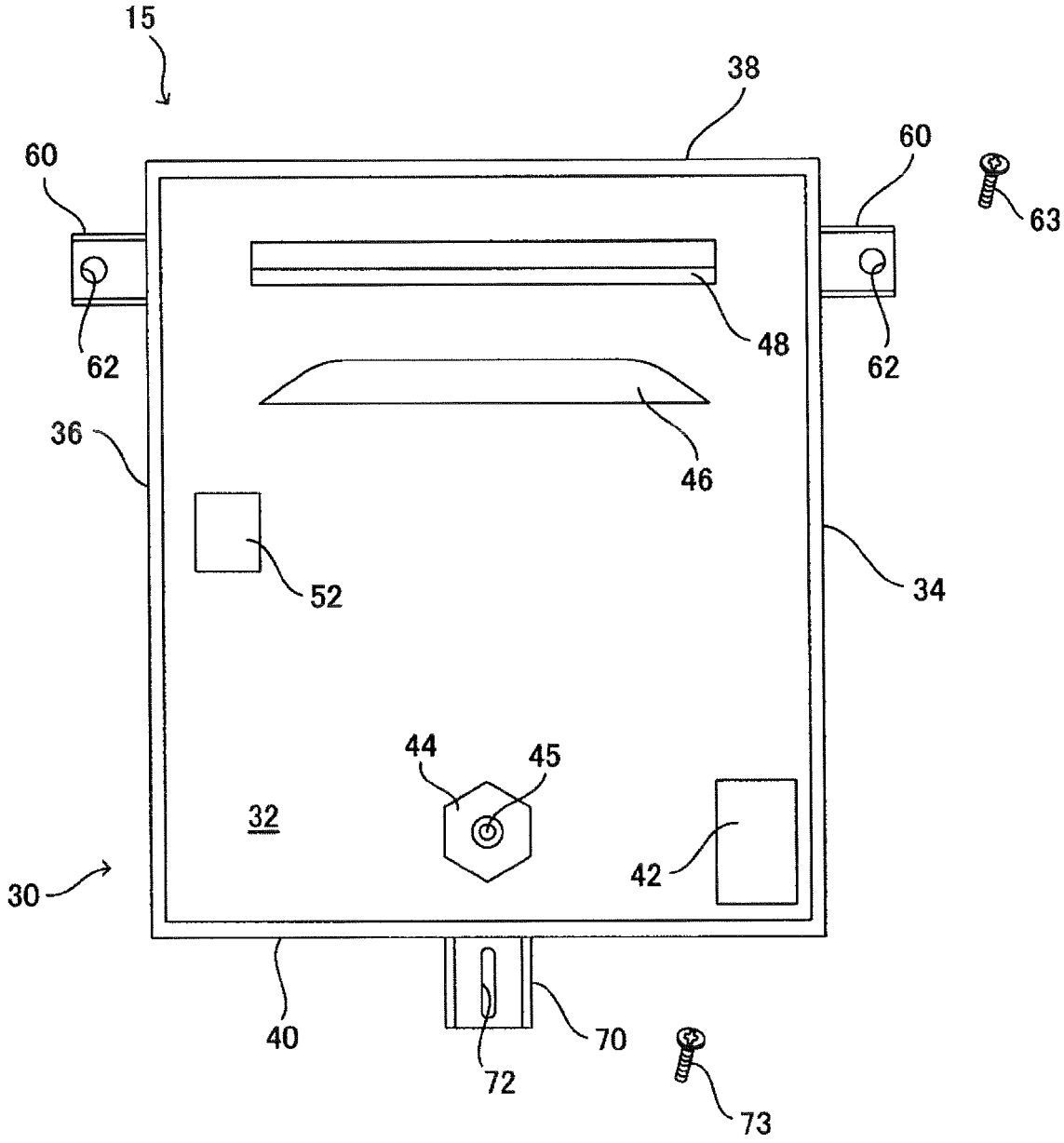
FIG. 2 is a plan view of an exposing device shown in FIG. 1.

The exposing unit 15 will now be described in detail with reference to FIG. 2 and FIG. 3. Various kinds of optical devices are incorporated into the exposing unit 15. The exposing unit 15 has a unit main body 30 of an almost square shape when viewed in plane. The unit main body 30 is integrally formed by means of resin molding and covered with an unillustrated lid member.

The unit main body 30 has a bottom surface 32 (installment surface) of an almost square shape. A first side wall 38 is provided to stand on one side edge (first side edge) of the bottom surface 32, and a second side wall 40 is provided to stand upward on the side edge (second side edge) opposing the first side wall 38. Also, a third side wall 34 and a fourth side wall 36 are provided to stand, respectively, on two side edges (third side edge and fourth side edge) of the bottom surface 32 that are orthogonal to the first side wall 38 and the second side wall 40.

Components, such as a light source 42, a polygon mirror (polygonal rotating mirror) 44, an Fθ lens 46, a plane mirror 48 (reflection mirror), and a BD (beam detector) 52, are disposed at appropriate positions on the bottom surface 32 of the unit main body 30 at specific optical intervals. A laser beam emitted from the light source 42 goes incident on the photoconductive drum 18 by passing the polygon mirror 44, the Fθ lens 46, and the plane mirror 48.

The light source 42 includes a substrate into which is incorporated a laser diode, and emits a laser beam toward the polygon mirror 44. The polygon mirror 44 is disposed in the vicinity of the second side wall 40. It has a shape of a regular hexagonal column sliced into a thin plate, and each of the six side surfaces is formed of a plane mirror. The center portion of the mirror 44 is fixed to a shaft 45, and the shaft 45 rotates at a high speed upon receipt of motive power of an unillustrated motor. Accordingly, the polygon mirror 44 scans and deflects a laser beam coming incident thereon from the light source 42 in a specific scanning direction in which the plane mirror 48 is positioned.

The Fθ lens 46 adjusts an optical path of a laser beam to maintain the scanning rate of a laser beam constant on the surface of the photoconductive drum 18. After the optical path is adjusted, the laser beam goes incident on the plane mirror 48.

The plane mirror 48 has an oblong reflection surface elongated in the scanning direction of scanning light from the polygon mirror 44 and is disposed in the vicinity of the first side wall 38. The plane mirror 48 reflects a laser beam from the polygon mirror 44 over the scan range. Also, as is shown in FIG. 3, a rectangular opening 50 is made in the bottom surface 32 in the vicinity of the first side wall 38, so that the laser beam reflected at reflection points on the mirror 48 goes incident on the drum 18 via the opening 50 (see FIG. 1).

The BD 52 has a two-dimensional light receiving surface of a size of several millimeters and detects whether the laser beam from the polygon mirror 44 has reached a specific reference position. Timing with the paper and the scan range are determined according to this detection result.

The exposing unit 15 is supported on the apparatus main body 2 at three positions: the third side wall 34, the fourth side wall 36, and the second side wall 40. To be more concrete, as is shown in FIG. 2, a pair of leg portions 60 and 60 (attachment fixing portions; first leg portions) each extending outward is provided to the third side wall 34 and the fourth side wall 36. These leg portions 60 are provided on the both sides of the plane mirror 48, that is, to protrude from the respective third side wall 34 and fourth side wall 36 along a direction in which the reflection surface of the plane mirror 48 extends.

Figure 3:
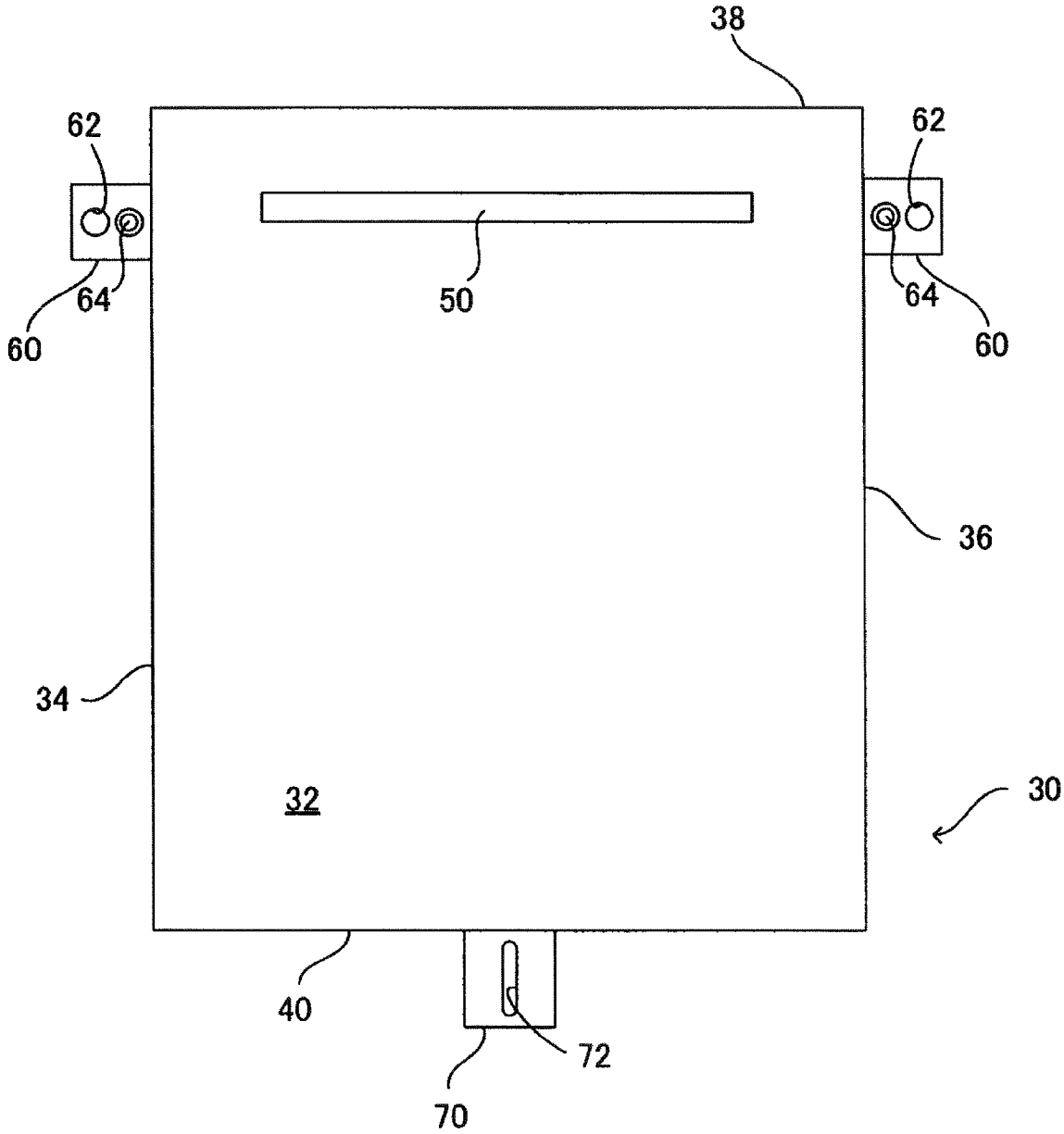
FIG. 3 is a bottom view of the exposing device.
Figure 4:
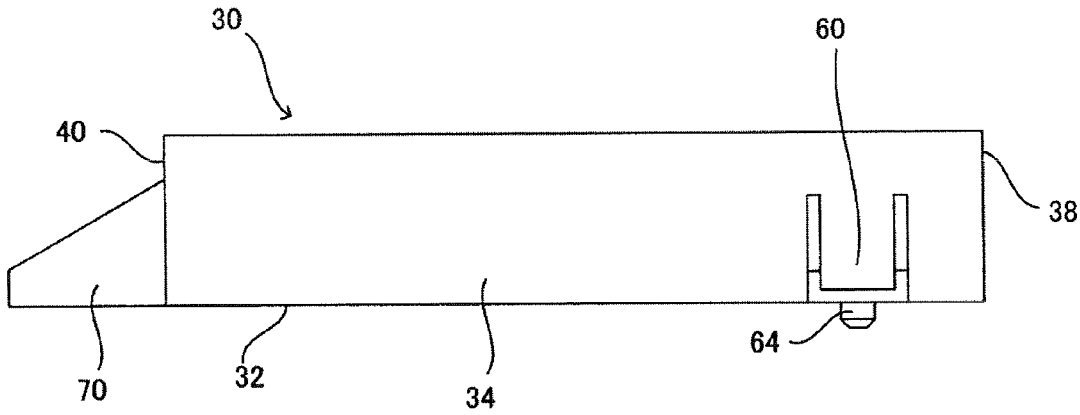
FIG. 4 is a side view of the exposing device.
Figure 5:
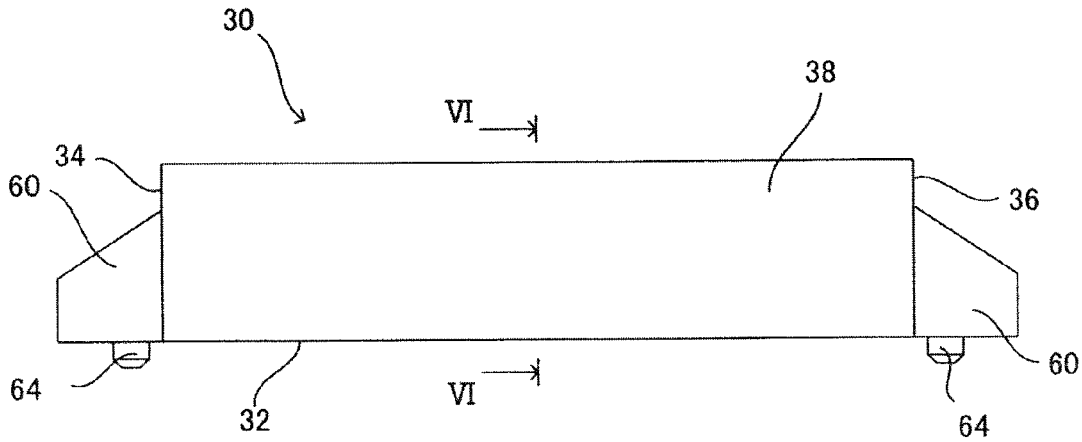
FIG. 5 is a front view of the exposing device.

Also, as are shown in FIG. 3 through FIG. 5, a boss 64 (protruding piece) protruding downward is formed on the bottom surface (fixing surface) of each leg portion 60. The bosses 64 are formed on almost the same straight line linking plural reflection points formed on the plane mirror 48 when scanning light is scanned. Supporting portions (first supporting portions) having holes for the bosses 64 to be fit therein are provided to the apparatus main body 2 (not shown), and the installment position of the unit main body 30 is determined by this configuration. The term, "on almost the same straight line", means a range within the projection width of the plane mirror 48.

A hole 62 is perforated in each leg portion 60 so as to penetrate through the bottom surface thereof, and the holes 62 are also formed on almost the same straight line linking the reflection points. A screw 63 (fixing member) is inserted into each hole 62 from above and threaded into another hole provided in the corresponding first supporting portion of the apparatus main body 2. The unit main body 30 is thus fixed to the apparatus main body 2.

Meanwhile, a leg portion 70 (attachment supporting portion; second leg portion) extending outward is provided to the second side wall 40 in the vicinity of which the polygonal mirror 44 is disposed. A groove 72 (guiding groove) in the shape of an elongated hole is perforated in the leg portion 70 so as to penetrate through the bottom surface (sliding surface) thereof. The groove 72 is formed on the same line including the shaft 45 of the polygon mirror 44, that is, on the optical axis of the optical system inside the exposing unit 15. A screw 73 (guiding member) is inserted into the groove 72 from above and threaded into a hole provided in the second supporting portion (not shown) in the apparatus main body 2. The leg portion 70 is consequently supported on the second supporting portion in a slidable manner. The unit main body 30 is thus supported on the apparatus main body 2 in a movable manner within a forming range of the groove 72.

The protruding directions of the bosses 64 and the insertion directions of the screws 63 and 73 can be changed as needed to suit the fixing position of the exposing unit 15.

An operation of the printer 1 having the exposing unit 15 will now be described. Sheets of paper P before printing are stored in the paper feeding cassette 6 in a piled state. When printer 1 executes printing, sheets of paper P from the cassette 6 are separated and fed one by one by the paper feeding portion 8. The paper P thus sent reaches the registration roller 14 by passing through the paper transportation path 12. The roller 14 sends the paper P to the transfer portion 90 while correcting skew feeding of the paper P and matching the timing with a toner image being formed in the image forming portion 16.

Image data is transmitted to the printer 1 from an unillustrated external computer. The image data includes various images, such as characters, signs, figures, symbols, lines, and patterns, in the form of data. The printer 1 controls irradiation of a laser beam L by the exposing unit 15 according to the data. Accordingly, an electrostatic latent image of an original image is formed on the photoconductive drum 18 in the image forming portion 16, and a toner image is then formed on the drum 18 from this electrostatic latent image. This toner image is transferred onto the sheet P at the transfer nip portion between the drum 18 and the roller 91.

Subsequently, the paper P is sent toward the fixing portion 92 while bearing a non-fixed toner image thereon, and the toner image is fixed on the paper P by a heat roller in the fixing portion 92. The paper P discharged from the fixing portion 92 is then sent upward by passing through the paper transportation path 94 to be discharged in the paper discharging portion 96.

In contrast to the simplex printing as above, in a case where duplex printing is executed in the printer 1, the transportation directions of the paper P discharged from the fixing portion 92 are switched immediately before it is discharged into the paper discharge portion 96. In other words, the paper P on one of the surfaces which has been printed an image is pulled backward into the paper transportation path 94 and transported through the paper transportation path 98. Subsequently, the paper P merges into the paper transportation path 12 immediately downstream of the paper feeding portion 8 to be sent again to the transportation portion 90. In this instance, because the printed surface faces downward, when the paper P is sent again to the transfer portion 90, a toner image is transferred onto the other surface of the paper P on which no image has been printed.

The printer 1 of this embodiment described above is characterized in that it is devised to maintain the relative positions between the plane mirror 48 and the photoconductive drum 18 invariant.

Figure 6:
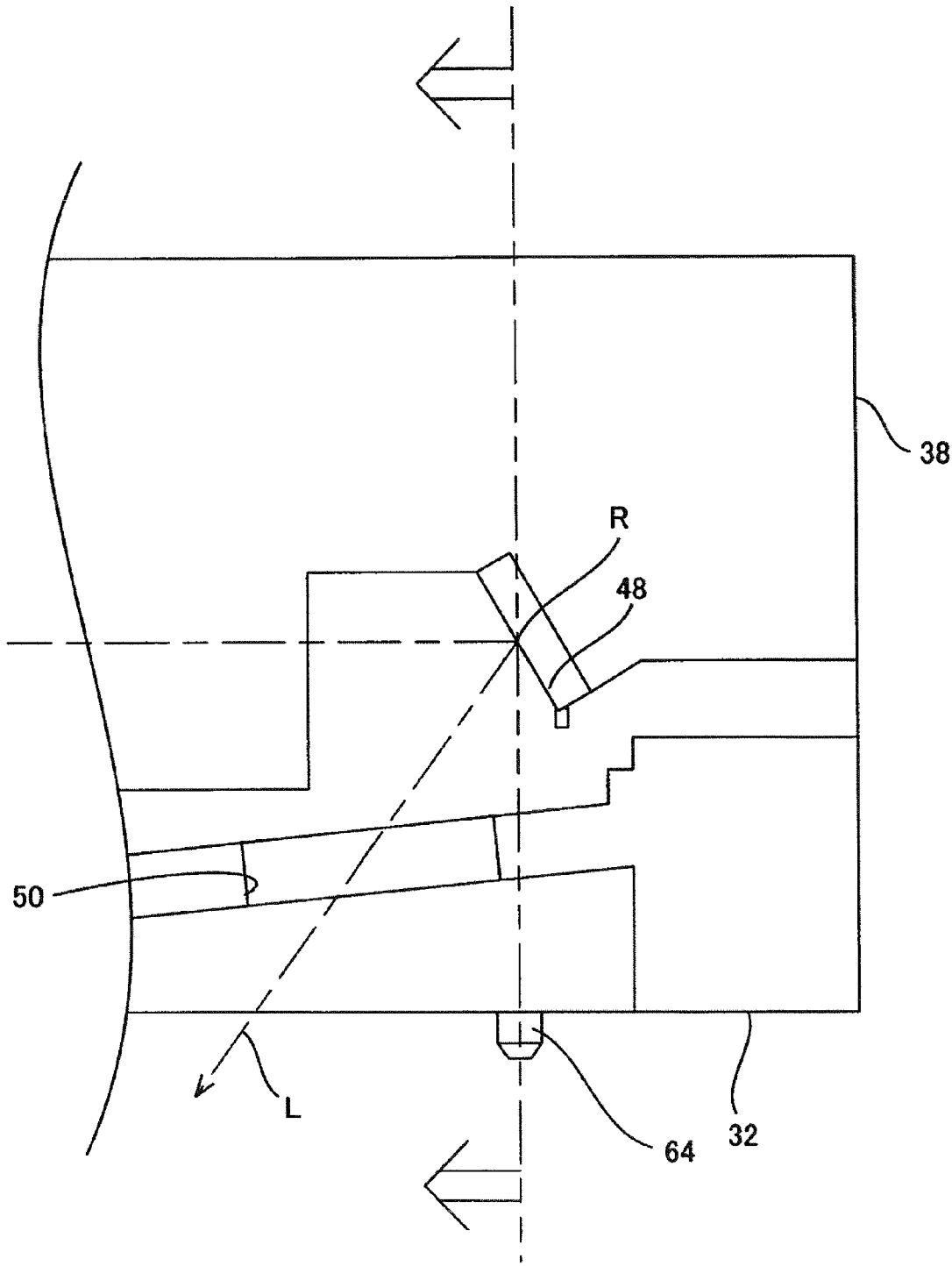
FIG. 6 is an enlarged cross section of a major portion taken on line VI-VI of FIG. 5.

More specifically, according to this embodiment, the exposing unit 15 has the unit main body 30 into which are incorporated the polygon mirror 44 and the plane mirror 48, and the main body 30 is attached to the apparatus main body 2. The screws 63 and the bosses 64 are present on the side where the plane mirror 48 is installed, that is, on almost the same straight line linking the reflection points R (FIG. 6) in the width direction of the first side wall 38, and a pair of the leg portions 60 and 60 is fixed to the apparatus main body 2 by these screws 63 and bosses 64. On the contrary, the screw 73 is provided on the side where the polygon mirror 44 is installed and the leg portion 70 is supported on the apparatus main body 2 in a slidable manner for allowing free expansion of the unit main body 30 while being guided by the screw 73.

Accordingly, even when the unit main body 30 expands due to heat generation inside the apparatus main body 2 or heat generation by the motor of the polygon mirror 44, the installment position of the polygon mirror 44 alone varies and the installment position of the plane mirror 48 remains invariant. This is because the unit main body 30 is immovable at the positions of the screws 63 and the bosses 64 whereas it is movable at the position of the screw 73. This configuration allows the unit main body 30 to move backward from the starting position, which is a position in the height direction of the first side wall 38 indicated by a chain double-dashed line in FIG. 6, that is, in a direction indicated by arrows (the optical axis direction of the optical system) while the starting point portion is maintained at the original position.

As a consequence, although the optical path length from the polygon mirror 44 and the plane mirror 48 becomes longer, the relative positions between the plane mirror 48 and the photoconductive drum 18 remain invariant. Hence, the characteristic (the exposing characteristic, such as a beam diameter forming an image) does not change on the surface of the drum 18. A desired irradiation position can be therefore attained, which makes it possible to constantly form an appropriate electrostatic latent image on the drum 18. In particular, the optical axis will not undergo displacement when movements in the optical axis direction are allowed at the installment position of the polygon mirror 44. This consequently eliminates displacement of the image transfer position.

In addition, because the position of the unit main body 30 is determined by the bosses 64 and it is fixed to the apparatus main body 2 with the screws 63, it can be readily installed in the apparatus main body 2. Moreover, because these screws 63 and bosses 64 are provided on almost the same straight line linking the reflection points R, they have no influence on the relative positions between the mirror 48 and the drum 18.

Further, because the characteristic on the surface of the drum 18 remains unchanged, a satisfactory image quality can be obtained, which can contribute to enhancement of the reliability of the printer 1.

It should be appreciated that the invention is not limited to the embodiment above and various modifications are possible within the scope of the appended claims.

For example, in the embodiment above, the groove 72 is formed on the same line including the shaft 45 of the polygon mirror 44. The invention, however, is not necessarily limited to this configuration. More specifically, the installment side of the polygon mirror 44, that is, the second side wall 40 on the opposite side to the installment position of the plane mirror 48 may be allowed to move in a plane forming direction including the scanning direction of the polygon mirror 44, in other words, in a direction parallel to the bottom surface 32. Alternatively, the second side wall 40 may be supported on the apparatus main body 2 by an elastic member, such as a spring. In these cases, too, it is possible to achieve the advantage that the relative positions between the plane mirror and the photoconductive drum remain invariant even in the presence of a temperature change as in the embodiment above.

Further, the reflection mirror of the invention may be a mirror other than the plane mirror, such as a cylindrical mirror. Also, the embodiment above described a case where the image forming apparatus is implemented as a printer. However, it goes without saying that the image forming apparatus of the invention is also applicable to a copying machine and a facsimile machine.

The specific embodiment described above chiefly includes an invention having the following configurations.

An exposing device according to an aspect of the invention is an exposing device installed in an image forming apparatus main body having an image carrier, including: a light source that emits scanning light; a polygonal rotating mirror that scans and deflects the scanning light in a specific scanning direction; a reflection mirror that reflects the scanning light that has been scanned and deflected at plural reflection points aligned in a specific direction for the scanning light to go incident on the image carrier; and a unit main body in which the polygonal rotating mirror and the reflection mirror are disposed at a specific interval, wherein the unit main body includes: a pair of attachment fixing portions that are provided on almost a same line linking the plural reflection points and fixed to the apparatus main body; and an attachment supporting portion that is supported on the apparatus main body and allows free expansion of the unit main body in a plane direction including the scanning direction of the polygonal rotating mirror on a side where the polygonal rotating mirror is installed.

According to this configuration, even when the unit main body expands due to heat transmitted from inside the apparatus main body or heat generation of the polygonal rotating mirror, the installment position of the polygonal rotating mirror alone varies and the installment position of the reflection mirror remains invariant. As a consequence, because the relative positions between the reflection mirror and the image carrier remain invariant and the characteristic on the surface of the image carrier remains unchanged, it is possible to constantly form an appropriate electrostatic latent image.

In the configuration above, it is preferable that the unit main body is allowed to undergo free expansion along an optical axis direction of an optical system from the light source to the reflection mirror on the side where the polygonal rotating mirror is installed.

According to this configuration, because expansion is allowed in the optical axis direction on the side where the polygonal rotating mirror is installed, the optical axis will not undergo displacement, which eliminates displacement of the image transfer position.

In the configuration above, it is preferable that each of the attachment fixing portions includes a protruding piece that determines an installment position of the unit main body with respect to the apparatus main body, and a fixing portion that fixes the unit main body to the apparatus main body. According to this configuration, the unit main body can be readily installed in the apparatus main body.

In the configuration above, it is preferable that the attachment supporting portion includes a guiding groove that extends in the optical axis direction, and a guiding member that is fixed to the apparatus main body and allowed to move inside the guiding groove.

An exposing device according to another aspect of the invention is an exposing device installed in an image forming apparatus main body having an image carrier, including: a light source that emits scanning light; a polygonal rotating mirror that scans and deflects the scanning light in a specific scanning direction; a plane mirror that has a reflection surface extending in a scanning direction of the scanning light of the polygonal rotating mirror to let the scanning light go incident on the image carrier; and a unit main body that has an installment surface of an almost square shape when viewed in plane, in which the polygonal rotating mirror and the plane mirror are disposed on the installment surface, wherein the plane mirror is disposed in the vicinity of a first side edge of the installment surface and the polygonal rotating mirror is disposed in the vicinity of a second side edge opposing the first side edge, the unit main body including installment fixing portions that are provided to extend respectively from a third side edge and a fourth side edge orthogonal to the first side edge and the second side edge along a direction in which the reflection surface of the plane mirror extends and fixed to the apparatus main body, and an attachment supporting portion that is provided to extend from the second side edge of the installment surface for allowing free expansion of the unit main body in a plane direction including the scanning direction of the polygonal rotating mirror on a side of the second side edge and supported on the apparatus main body.

An image forming apparatus according to still another aspect of the invention includes: an image carrier on which an electrostatic latent image is formed; an exposing device that forms the electrostatic latent image by irradiating scanning light on a surface of the image carrier; an apparatus main body that accommodates therein the image carrier and the exposing device; first supporting portions that are provided inside the apparatus main body so as to support the exposing device fixedly; and a second supporting portion that is provided inside the apparatus main body so as to allow free expansion of the exposing device, wherein the exposing device includes: a light source that emits scanning light; a polygonal rotating mirror that scans and deflects the scanning light in a specific scanning direction; a plane mirror that has a reflection surface extending in a scanning direction of the scanning light of the polygonal rotating mirror to let the scanning light go incident on the image carrier; and a unit main body that has an installment surface of an almost square shape when viewed in plane, in which the polygonal rotating mirror and the plane mirror are disposed on the installment surface, and wherein the plane mirror is disposed in the vicinity of a first side edge of the installment surface and the polygonal rotating mirror is disposed in the vicinity of a second side edge opposing the first side edge, the unit main body including installment fixing portions that are provided to extend respectively from a third side edge and a fourth side edge orthogonal to the first side edge and the second side edge along a direction in which the reflection surface of the plane mirror extends and supported on the first supporting portions, and an attachment supporting portion that is provided to extend from the second side edge of the installment surface for allowing free expansion of the unit main body in a plane direction including the scanning direction of the polygonal rotating mirror on a side of the second side edge and supported on the second supporting portion.

According to this configuration, by incorporating the exposing device described above, a satisfactory image quality can be obtained because the characteristic on the surface of the image carrier remains unchanged, which can contribute to enhancement of the reliability of the image forming apparatus.

This application is based on patent application No. 2007-019440 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An exposing device installed in an image forming apparatus main body having an image carrier, comprising:

a light source that emits scanning light;

a polygonal rotating mirror that scans and deflects the scanning light in a specific scanning direction;

a reflection mirror that reflects the scanning light that has been scanned and deflected at plural reflection points aligned in a specific direction for the scanning light to go incident on the image carrier, the reflection mirror being spaced from the polygonal rotating mirror along an optical axis direction that is normal to the specific direction of the plural reflection points of the reflection mirror; and a unit main body in which the polygonal rotating mirror and the reflection mirror are disposed at a specific interval along the optical axis direction, wherein the unit main body includes:

a pair of attachment fixing portions that are provided on almost a same line linking the plural reflection points and fixed to the apparatus main body; and an attachment supporting portion that is supported on the apparatus main body and allows free expansion of the unit main body in a plane direction including the scanning direction of the polygonal rotating mirror and along the optical axis direction on a side where the polygonal rotating mirror is installed, wherein said attachment fixing portions fix the unit main body to the apparatus main body in such a manner that at least the movements of said reflection mirror in the optical axis direction are restricted.

2. The exposing device according to claim 1, wherein:

the unit main body is allowed to undergo free expansion along an optical axis direction of an optical system from the light source to the reflection mirror on the side where the polygonal rotating mirror is installed.

3. The exposing device according to claim 2, wherein the attachment supporting portion includes:

a guiding groove that extends in the optical axis direction; and a guiding member that is fixed to the apparatus main body and allowed to move inside the guiding groove.

4. An exposing device installed in an image forming apparatus main body having an image carrier, comprising:

a light source that emits scanning light;

a polygonal rotating mirror that scans and deflects the scanning light in a specific scanning direction;

a plane mirror that has a reflection surface extending in a scanning direction of the scanning light of the polygonal rotating mirror to let the scanning light go incident on the image carrier, the plane mirror being spaced from the polygonal rotating mirror along an optical axis direction that is normal to the scanning direction; and a unit main body that has a substantially rectangular installment surface on which the polygonal rotating mirror and the plane mirror are disposed, wherein the plane mirror is disposed in the vicinity of a first side edge of the installment surface and the polygonal rotating mirror is disposed in the vicinity of a second side edge opposing the first side edge, so that the polygonal rotating mirror is spaced from the plane mirror in an optical axis direction that is normal to the scanning direction along the plane mirror;

the unit main body including, attachment fixing portions that are provided to extend respectively from a third side edge and a fourth side edge orthogonal to the first side edge and the second side edge along a direction in which the reflection surface of the plane mirror extends and fixed to the apparatus main body, each of the attachment fixing portions including a protruding piece protruding downwardly on the attachment fixing portion and determining an installment position of the unit main body with respect to the apparatus main body and a fixing portion that fixes the unit main body to the apparatus main body; and an attachment supporting portion that is provided to extend from the second side edge of the installment surface for allowing free expansion of the unit main body in a plane direction including the scanning direction by the polygonal rotating mirror and along the optical axis direction on a side of the second side edge and supported on the apparatus main body, wherein said attachment fixing portions fix the unit main body to the apparatus main body in such a manner that at least the movements of the plane mirror in the optical axis direction are restricted.

5. The exposing device according to claim 4, wherein:

the unit main body is allowed to undergo free expansion along an optical axis direction of an optical system from the light source to the reflection mirror on the side of the second side edge.

6. The exposing device according to claim 4, wherein each of the attachment fixing portions includes:

a first leg portion that has a fixing surface;

the fixing member being inserted through the hole to fix the apparatus main body and the first leg portion;

a hole that penetrates through the fixing surface of the first leg portion; and a fixing member that is inserted through the hole to fix the apparatus main body and the first leg portion.

7. The exposing device according to claim 5, wherein the attachment supporting portion includes:

a second leg portion that has a sliding surface;

a long hole that is made in the second leg portion and extends in the optical axis direction; and a guiding member that is fixed to the apparatus main body and allowed to move inside the long hole.

8. The exposing device according to claim 4, wherein the attachment fixing portions extend respectively from the third and fourth side edges of the attachment surface at positions in the vicinity of the first side edge of the installment surface, the installment fixing portions being fixed to the apparatus main body and preventing portions of the installment surface in the vicinity of the first side edge thereof from moving in directions parallel to the direction in which the reflection surface of the plane mirror extends, in directions parallel to the optical axis direction and in directions that include the scanning direction by the polygonal rotating mirror.

9. The exposing device according to claim 6, wherein the protruding piece of each attachment fixing portion is spaced from the hole thereof.

10. An image forming apparatus, comprising:

an image carrier on which an electrostatic latent image is formed;

an exposing device that forms the electrostatic latent image by irradiating scanning light on a surface of the image carrier;

an apparatus main body that accommodates therein the image carrier and the exposing device;

first supporting portions that are provided inside the apparatus main body so as to support the exposing device fixedly; and a second supporting portion that is provided inside the apparatus main body so as to allow free expansion of the exposing device, wherein the exposing device includes:

a light source that emits scanning light;

a polygonal rotating mirror that scans and deflects the scanning light in a specific scanning direction;

a plane mirror that has a reflection surface extending in a scanning direction of the scanning light of the polygonal rotating mirror to let the scanning light go incident on the image carrier; and a unit main body that has a substantially rectangular installment surface on which the polygonal rotating mirror and the plane mirror are disposed, and wherein the plane mirror is disposed in the vicinity of a first side edge of the installment surface and the polygonal rotating mirror is disposed in the vicinity of a second side edge opposing the first side edge, so that the polygonal rotating mirror is spaced from the plane mirror in an optical axis direction that is normal to the scanning direction along the plane mirror, the unit main body including, attachment fixing portions that are provided to extend respectively from a third side edge and a fourth side edge orthogonal to the first side edge and the second side edge along a direction in which the reflection surface of the plane mirror extends and supported on the first supporting portions, each of the attachment fixing portions including a protruding piece protruding downwardly on the attachment fixing portion and determining an installment position of the unit main body with respect to the apparatus main body and a fixing portion that fixes the unit main body to the apparatus main body; and an attachment supporting portion that is provided to extend from the second side edge of the installment surface for allowing free expansion of the unit main body in a plane direction including the scanning direction of the polygonal rotating mirror and along the optical axis direction on a side of the second side edge and supported on the second supporting portion, wherein said attachment fixing portions fix the unit main body to the apparatus main body in such a manner that at least the movements of the plane mirror in the optical axis direction are restricted.

11. The image forming apparatus according to claim 10, wherein:

the unit main body is allowed to undergo free expansion along an optical axis direction of an optical system from the light source to the reflection mirror on the side of the second side edge.

12. The image forming apparatus according to claim 10, wherein each of the attachment fixing portions includes:

a first leg portion that has a fixing surface in a shape of a flat plate;

the protruding piece protruding from the fixing surface of the first leg portion;

a hole that penetrates through the fixing surface of the first leg portion; and the fixing member being inserted through the hole to fix the apparatus main body and the first leg portion.

13. The image forming apparatus according to claim 11, wherein the attachment supporting portion includes:

a second leg portion that has a sliding surface;

a long hole that is made in the second leg portion and extends in the optical axis direction; and a guiding member that is fixed to the apparatus main body and allowed to move inside the long hole.

14. The image forming apparatus according to claim 12, wherein the protruding piece of each attachment fixing portion is spaced from the hole thereof.

15. The image forming apparatus according to claim 10, wherein the attachment fixing portions extend respectively from the third and fourth side edges of the installment surface at positions in the vicinity of the first side edge of the installment surface, the attachment fixing portions being fixed to the apparatus main body and preventing portions of the installment surface in the vicinity of the first side edge thereof from moving in directions parallel to the direction in which the reflection surface of the plane mirror extends, in directions parallel to the optical axis direction and in directions that include the scanning direction by the polygonal rotating mirror.

* * * * *